US006182871B1

(12) United States Patent
Lam

(10) Patent No.: US 6,182,871 B1
(45) Date of Patent: Feb. 6, 2001

(54) PERSONALIZED GARMENT COORDINATION APPARATUS

(76) Inventor: Peter Ar-Fu Lam, 20104 Wayne Ave., Torrance, CA (US) 90503

( * ) Notice: Under 35 U.S.C. 154(b), the term of this patent shall be extended for 0 days.

(21) Appl. No.: 09/374,657

(22) Filed: Aug. 16, 1999

Related U.S. Application Data

(63) Continuation-in-part of application No. 08/375,534, filed on Jan. 9, 1995, now Pat. No. 5,649,651, which is a continuation-in-part of application No. 08/812,530, filed on Mar. 8, 1997, now Pat. No. 5,938,088.

(51) Int. Cl.[7] ..... A41M 5/00

(52) U.S. Cl. ..... 223/120

(58) Field of Search ..... 223/1, 120, 85, 223/92, 88

(56) References Cited

U.S. PATENT DOCUMENTS

| | | | | |
|---|---|---|---|---|
| D. 253,447 | * | 11/1979 | Tully | D6/248 |
| 2,498,886 | * | 2/1950 | Suhajda | 223/120 |
| 2,919,501 | * | 1/1960 | Settler | 223/120 |
| 4,739,911 | * | 4/1988 | Quinn | 223/120 |
| 4,792,071 | * | 12/1988 | Scarpe et al. | 223/120 |
| 5,938,088 | * | 8/1999 | Lam | 223/85 |

* cited by examiner

*Primary Examiner*—Bibhu Mohanty

(57) ABSTRACT

An apparatus especially configured for users to easily coordinate or harmonize apparel before putting the clothing on. The embodiments include a frame member defining a display region configured for displaying the personalized real human facial image of a user. In a first embodiment, the display region is positioned on top of a garment supporting device. In a second embodiment, the display region comprises a computer monitor. In a third embodiment, the facial or garment image is retrieved from a remote computer.

23 Claims, 6 Drawing Sheets

PERSONALIZED GARMENT COORDINATION APPARATUS

RELATED APPLICATIONS

This application is a continuation-in-part of Ser. No. 08/375,534 filed Jan. 9, 1995, is now issued U.S. Pat. No. 5,649,651 and pending issue Ser. No. 08/812,530 filed Mar. 8, 1997, is now U.S. Pat. No. 5,938,088 which are by reference incorporated herein.

BACKGROUND OF THE INVENTION

This application is to further precisely defining the variation and enhancement of U.S. patent application No. 08/812,530 filed Mar. 8, 1997.

This invention relates generally to apparatus for facilitating a user to select, coordinate, appraise and harmonize garment clothing without actually putting on the garment.

The prior art reveals many garment hangers having a facial drawing combined with a garment hanger for store display purposes. For example only, attention is directed to the following U.S. Pat. Nos:

Des. 253,447 1,096,018 3,126,237 4,739,911

SUMMARY OF THE INVENTION

The present invention is firstly directed to an apparatus especially configured to encourage children to produce and display handicraft works while also encouraging them to properly care for their articles of clothing, as disclosed in applicant's issued U.S. Pat. No. 5,649,651. The embodiments of the invention include a frame member defining a display region configured for removably accommodating a child's handicraft. In a first preferred embodiment, the frame member is especially configured for accommodating a substantially planar, i.e., two dimensional, handicraft in the display region.

In accordance with the preferred embodiments, first and second elongate arms extend in opposite directions from the frame member for supporting articles of clothing. Additionally, a hook member extends from the frame member for vertically suspending the frame member from a horizontally oriented support surface, e.g., on a stationary hook, a door top, or a rod.

In accordance with the first embodiment, the frame member defines the periphery of a display area for accommodating a substantially planar handicraft having a decorative front face of a person or a cartoon character. The handicraft may include different forms of presentation such as a picture, drawing, painting, photograph or needlework. The concept of handicraft includes the formation of art, picture, facial illustrations with the support of computers, computer software, computer printer as means to form the personalized handicraft. The frame member preferably includes a backing panel and a transparent display panel. The display panel is preferably configured for removable mounting on the frame member thus allowing the handicraft to be placed between the backing and display panels with its decorative front face visible through the transparent display panel.

An enhancement of this prior art may be in the form of a photograph representing the life-size visual representation of a particular user's face. Such apparatus can be especially featured to provide an unusual application so as to assist the user in selecting clothing articles which coordinate to form an attractive outfit for that user. It is known in the art to provide facilities in tourist spots to capture user's facial illustration by photographic techniques and print the facial image in reduced size on a plate, mug or T-shirt for souvenir purpose. The concept of the invention can be readily extended to provide a garment hanger equipped with a life-size facial illustration of the user in these tourist spots so as to provide a more meaningful and useful souvenir. Another application of the invention is for an apparel retail shop to instantly capture the life size facial image of the preferred customer and print it on the medial portion of a garment hanger. The customer then make use of this special apparatus to support and coordinate their selected apparel and has a quick appraisal of the harmony effect with his/her face on it without actually putting on the apparel.

In accordance of a third embodiment, the invented apparatus can be configured to receive a regular garment hanger supporting an apparel. This design enables the customer to have an instant viewing of the apparel to see if it matches with his/her face without removing the garment from its hanger and put it onto the first embodiment for displaying with a facial image of the user.

In accordance of another preferred embodiment, the frame member is configured in the form of a stand. A display region is formed proximate to the top of the stand for the displaying a personalized facial image. Receiver means such as hooks or receiver slots are provided behind the display region to receive the hook of a garment hanger. For a user to coordinate or appraise the look with particular garment, the garment supported on regular hanger is attached to one of the receiver means to suspend the garment such that the garment looks to be wear by the user. The receiver means can be configured to enable vertical position adjustment so that the relative position of the garment from the facial image of the user can be adjusted to a proper location. A simple way to enable vertical adjustment is to offer more than one receiver hooks, one on top of another. For the apparatus to be used in a fashion store, in order to facilitate changing the facial image for different customers, the facial image is recommended to be printed onto a cardboard instead of printing directly onto the display region. This cardboard is then attached with the display member by attachment means such as double side tape or magnetic materials.

In order to provide a personalized facial image for a customer, the fashion store is equipped with a camera, the facial image of the customer is captured and digitized into electronics data. A code word is assigned to distinguish the digital image of one customer from another. Instead of interchangeably displaying the facial image onto the display apparatus, this facial image can be permanently printed onto a garment hanger having an adequately large display region located on top of the garment hanger and make it a personalized coordination apparatus. This personalized coordination apparatus is an invaluable hospitality facility for a frequent customer than the floor standing version. The customer may carry the personalized hanger around different areas of the store, and try different desirable apparel without actually putting on the apparel on. The set up increase the efficiency for customers to check the matching of apparel and encourage them to try more different designs without actually putting the apparel on. As a result a store with limited space can handle a greater customer flow because the time spent by a customer to complete the transaction is reduced. The number of changing rooms required the customer's shopping requirements is also reduced. The room efficiency is particular important for stores having a limited floor space. Another advantage is that some garment of special nature such as T-shirt of delicate material is not recommended to be tested as they tend to be deformed by customers.

The term personalize is important to distinguish the invention with the prior art having a hanger and a facial drawing displayed at the medial portion of the hanger, such as Tully, U.S. Design Pat. No. 253,447. In addition to the photo facial image of the user, this garment coordination apparatus is differentiated from the prior art with an important personalized nature. That is, the hanger created for one person may not be suitable for another person. A personalized coordination apparatus is a process with which a consumer has the right of choice which real person face image to be put onto the display region, most situations the facial image selected is that of the consumer, relatives, friends or other specifically selected person. The personalized process is defined by any of the following characteristics when compared with a commercial display hanger having a facial drawing. In a first situation, the facial image of the coordination apparatus is owned by the owner of the coordination apparatus, or it belongs to the person known to the consumer, such as relatives and known friends. Secondly, mostly one or two pieces of the coordination apparatus is required per owner; this property is distinctive with commercial displaying hangers having the same unique beautifully designed face made in high number of quantity. The image of choice is another characteristic of the subject invention. Consumer has a desire to possess the coordination apparatus because it has the facial image of choice. Commercial displaying hanger does not provide choice of facial image for the consumer. Fourthly, a personalized coordination apparatus invented will be fully utilized by it's owner, no matter if the facial image displayed is not outstanding, or not beautiful as judged by the common standard. Only beautifully designed facial image will be used for commercial displaying hangers. Fifthly, regarding to the location of use, the coordination apparatus is used by the owner at the store and also at home. This is significantly different when compared with commercial display hanger which is used only in stores. The sixth characteristic is that commercial display hanger are used to support the displaying garment hanger for an extended period of time whereas the personalized coordination apparatus is used only for short moments when it is used for coordination or appraising the matching effect of a garment. The seventh characteristic is that a special set up kiosk is required to be set up around a point of sale for a store to offer the invented personalized coordination service to all the customers. Commercial display hanger does not required a servicing kiosk because only one most pleasant looking face is required to be selected. The number eight characteristic is that proper coding system about the facial image is required by the subject invention to distinguish one face from another. As only the most desirable facial image is selected for the commercial display hanger, coding number is not required to represent the face selected. Another characteristic is that consumer usually may be required to pay for the personalized coordination apparatus while commercial display hanger is usually not for sale in a store. Any of these process characteristics defines the nature of the term "personalize" of the invented coordination apparatus, and distinguishes the subtle differences from a commercial display hanger.

Structurally, although a traditional garment hanger hook is applicable to carry the apparatus, a flat and comfortable handle is a more preferable design. In order to provide a friendly personalized service for different people, an efficient photo imaging process is required at a point of sale. A typical set up providing this service starts with a photo imaging device such as camera. Facilities to chroma-key and digitize the facial image such as scanner and also special photo treating software are also required. Alternatively digital camera can be used to replace the regular camera and scanner combination.

In a different embodiment, the display member is enhanced to a display monitor, such as a computer monitor with thin border. A thin profile LCD monitor is particularly suitable for this application. In one preferred embodiment, garment-supporting arms are positioned just below the computer monitor which displays the facial image of the customer. In another preferred embodiment receiver means is provided behind the computer monitor to receive the hook of a garment hanger which supports the garment to be viewed. Since computer monitors are expensive and bulky to be carried around, it is preferable to have the monitor mounted on a floor stand. A preferred process to make use of this facility is as follow:

(1) Provide a facial image capture set up at a point of sale.

(2) Facial image of customers are collected with this setup.

(3) The facial image is digitized into electronics data represented by numbers of 1 and 0; and stored in a file.

(4) A code word or file name is assigned to each file to identify the facial image of one customer from another.

(5) The file is decoded and displayed on the computer monitor mounted on top of the garment displaying stand.

(6) Input device such as key pad, joystick, mouse or other point device and even voice recognition device are used to identify which facial image is to be displayed and also to provide adjustment, options selection and modification of the facial image or the relative position of the image to be displayed.

Various facial image modification software are available in the market to change the color balance, provide visual effect and touch up deficiencies in the photo taking process. With more investment, multiple facial images of the customer from different viewing angles can be collected. In this situation, the display stand requires rotation means for the viewing garment to be rotated when the orientation of the facial image is changed. If multiple facial images are collected at a high frame rate such as 25 frames per second while the viewing angle is continuously changing, the playback of the facial image at the monitor will provide a movie like movement result. To fully match with the movie play back effect, such as a head is turning left or right, the garment displaying mechanism is required to be moved in the same direction and in synchronization with the head turning motion displayed. The overall result becomes an animated presentation of the garment coordination matching with the user.

Once a customer registered his/her facial image at a face image capturing facility, this image file identified by a code word can be sent to a remote computer by a communication channel. A network or communication channel refer to any means connecting two computing devices together, including internet, intranet, extranet, ISDN, DSL and LAN. The communication channel can be provided by wired lines such as cable, optical lines or telephone lines. It can be connected to the computer by any commercially format of communication such as COM port, parallel port and USB port. The communication channel can be furnished by wireless channel such as RF and infra red channels as well. A fashion store may also set up a library of images representing its garment collection at the remote computer. Garment images can be created by the same process to capture the electronics image file of a facial image; partially or completely created by image drafting software commercially available. With this service, customers may access the web site of the fashion store from the internet or the world wide web to fetch the file representing their facial images and/or the images of the garment to be selected. With the support of a proper software, the facial image of the customer and the garment can be combined and displayed on the computer monitor located at the home of the potential customer. Personalized animated fashion show is also possible if multiple facial images and the garment are provided. This service gives customers greater confidence before they placed mail orders and avoid returns. Alternatively, customers may preview their preferred garment, and coordinated with their facial image. After customers record their preference, they either place a mail order or go to a store to actually try their short listed preferences and then confirm their purchase.

The novel features of the invention are set forth with particularity in the appended claims. The invention will best be understood from the following description, when read in conjunction with the accompanying drawings.

DETAILED DESCRIPTION

Figure 1:
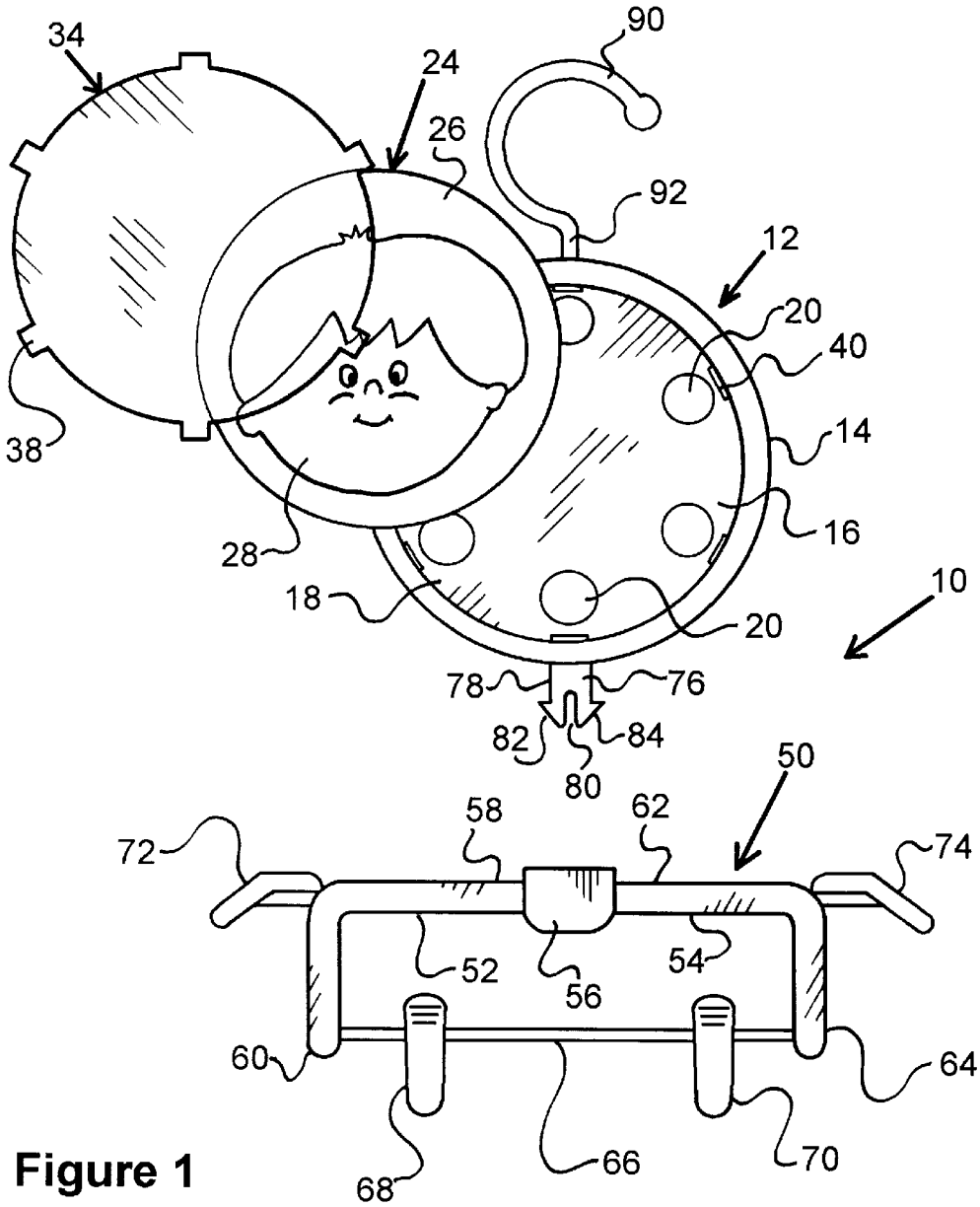
FIG. 1 is an exploded view of a first preferred embodiment of applicant's handicraft display apparatus.

Attention is initially directed to FIG. 1 which depicts an exploded view of a first embodiment 10 in accordance with the invention particularly configured to encourage a child to create and display a handicraft while also encouraging that child to properly care for his/her articles of clothing. The apparatus 10 is comprised of a frame member 12. The frame member 12 is formed by a substantially rigid peripheral member 14 which frames a display area 16. The peripheral member 14 is bridged by a backing panel 18. Holes 20 are preferably formed in the backing panel 18 to facilitate the removable mounting of a handicraft 24 in the display area 16 overlaying the backing panel 18. A suspension or hook member 90 extends radially outward from the frame member 12 for vertically suspending the structural member from a horizontally oriented supporting surface (not shown) such as a wall mounted hook, a door top, or a horizontal rod.

The handicraft 24 can comprise any of various planar structures having a front face 26 bearing a decorative pattern 28. The invention contemplates a great variety of decorative patterns and techniques for their formation. For example only, the handicraft 24 can comprise a picture, drawing, painting, photograph or needlework dimensioned to fit within the periphery defined by peripheral member 14. In perhaps its simplest form, the pattern 28 can be a hand drawing formed on a blank piece of paper. Alternatively, as will be discussed hereinafter, the pattern can be formed by various other art or craft techniques such as cutting out preprinted elements and adhering them to a base sheet.

As will be discussed hereinafter, it is intended that the handicraft 24 to be displayed be mounted against the backing panel 18 within the periphery defined by peripheral member 14. A transparent display panel 34 is provided and is intended for mounting on the frame member 12, sandwiching the handicraft 24 between the display panel 34 and backing panel 18, with the front face 26 of the handicraft 24 visible through the transparent display panel 34.

The display panel 34 is preferably provided with radially extending tabs 38 dimensioned and located to be removably received within mating slots 40 defined between the backing panel 18 and the peripheral member 14. The frame member 12 is configured for attachment to a device 50 for supporting clothing articles. The device 50 essentially is comprised of first and second arms 52, 54 which extend outwardly in opposite directions from a medial member 56. More particularly, arm 52 has a first end 58 secured to medial member 56 and a second substantially free end 60. Similarly, arm 54 has a first or inner end 62 secured to medial member 56 and a second free end 64. Ends 60 and 64 are preferably bridged by a bar 66 carrying spring urged clips 68, 70 suitable for holding a lower garment such as a skirt or trousers. Extender members 72 and 74 are respectively mounted on arms 52 and 54 for extending the effective width of the device 50 to enable the device to grow with a child as the child's clothing size increases. It should be noted that the device 50 is an embodiment to represent means to support a garment. Any realistic structure suitable for supporting a garment for display such as a frame is also include in the definition of the garment supporting means.

The frame member 12 is provided with a mounting member 76 for attaching the frame member to the device 50. More particularly, the mounting member 76 comprises a bifurcated stud 78 extending radially outward from the peripheral member 14. The stud is bifurcated by slot 80 which forms portions 82, 84 which can be resiliently urged together to enable them to pass into a slot (not shown) formed in medial member 56 for securing frame member 12 to device 50. A hook member 90 having a shaft 92 also extends radially from the peripheral member 14, substantially diametrically displaced from the mounting stud 78. When the embodiment is used to display life size human face photograph of the user to coordinate or appraise selection of apparel, the frame member (display member) 12 and the garment supporting device 50 are preferably to be separated parts to be attached together for use. This arrangement will enable a universal frame member 12 to be attached with different sizes of supporting device 50 to suit different body sizes of the users.

Figure 2A:
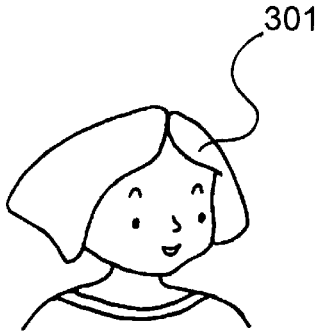
FIG. 2A illustrates a set up to capture the visual representation of a real human face.
Figure 2A:
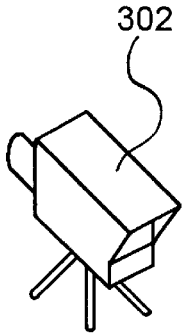
Figure 2B:
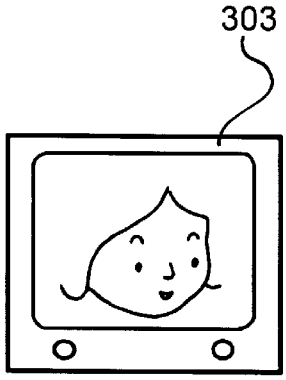
FIG. 2B illustrates the captured human face image to be displayed onto an electronics display device for monitoring, editing or modification purpose.

Attention is now directed to FIG. 2A and FIG. 2B. In accordance with the invention, a visual representation of a human face is formed on the display region 323 of display member 322. This visual representation can be created in various aforementioned ways of creating handicraft including conventional photography. However, it is contemplated that the preferred way would be to use a video camera 302 (FIG. 2A) to image the face of a user 301 with the output from a video camera being first presented on a display monitor 303 (FIG. 2B). The capture image of the face is then converted or digitized into digital data stored in electronic data storage means such as disk drive, tape and solid state memory. Utilizing editing techniques, an operator can manipulate the image as desired and then print a hard copy representation of the user's face. Typical editing or modification features may include the manipulation of colors, shapes, sizes, positions of the object (the human face) and the addition of computer generated visual effects. This hard copy is then mounted on the surface 323 of display member 322. More particularly, note display member 322 in FIG. 4 which bears on its surface 323 a visual representation of the edited image displayed by monitor 303. Alternatively, the captured real human face can be printed onto the display region 323 directly. Note in FIG. 5 that exemplary upper and lower garments are suspended from the invented apparatus. In order to support the lower garment such as trousers and skirts in appropriate position of the display set up, a suitable lower garment supporting means such as traditional skirt hanger is to be included into the display apparatus positioned in a suitable position beneath the upper garment supporting portion.

The apparatus having the facial image of a person is not only useful to the person himself; it can also be used by people to simulate the presence of their friends or relatives. For example, the apparatus may be used as a clothing gift selection tool by people to select appropriate for their friends or relatives without the actual presence of the person in the retail store.

Figure 5:
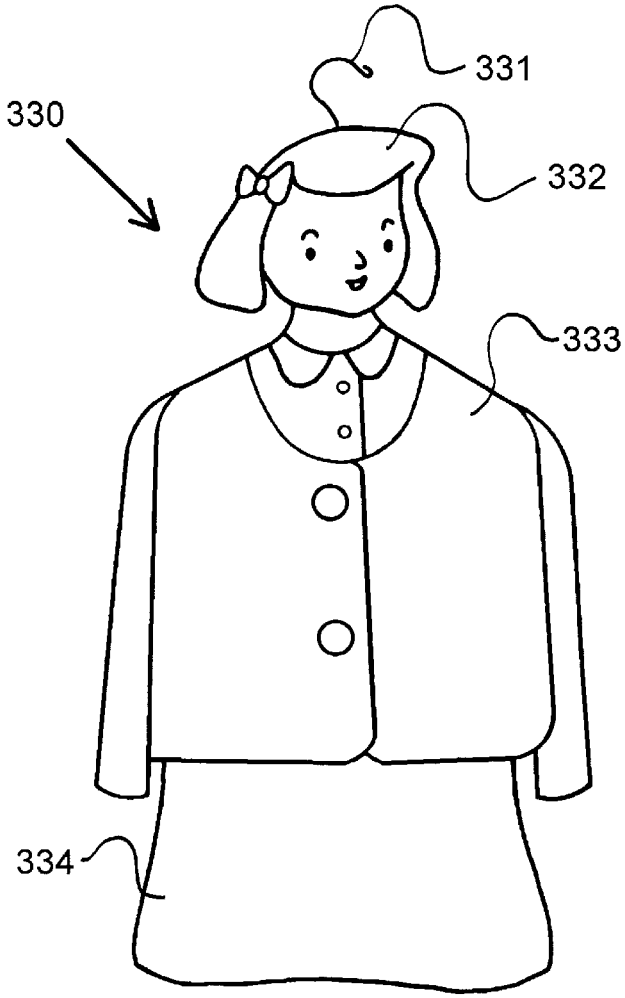
FIG. 5 is a finished view of the apparatus supporting an apparel to be viewed.
Figure 6:
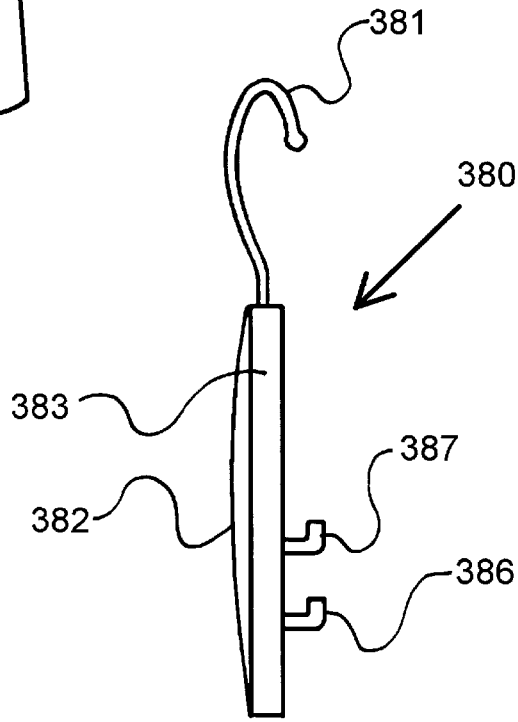
FIG. 6 is a side view of another embodiment to be attached with an apparel supported by a regular garment hanger to provide the similar desirable viewing effect.

All the above embodiments require the apparel to be put onto the hanger frame of the display apparatus to provide the visual effect. FIG. 6 depicts an improved embodiment such that multiple apparels supported on different garment hangers can be readily attached with the similar facial photographic frame one by one without actually removing the apparel from the respective garment hangers and to put it onto the supporting arms of the displaying apparatus. The display member 380 comprises a first suspension member 381, a facial image printing 382, a frame member 383 and a second suspension member 386. Similar to the suspension member 321 of FIG. 5, the first suspension member 381 is used as the hook of a regular garment hanger to support the display apparatus as well as the apparel supported. The second suspension member is to receive the hook member of an external regular garment hanger such that the apparel supported by the external garment hanger can be coordinated to a position appropriately below the facial illustration 382. It is desirable that the position of the second suspension member be adjustable in order to adjust the relative positions between the facial image and the apparel supported. Alternatively multiple selections of the second suspension members at different positions such as 386 and 387 are provided to offer the similar adjustable feature of the aforementioned second suspension member.

Figure 3A:
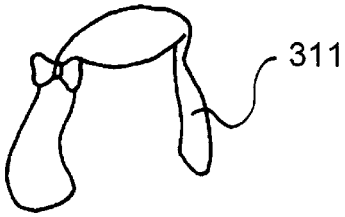
FIGS. 3A and 3B respectively depict hair simulation members to be placed in front of the facial image captured.
Figure 3B:
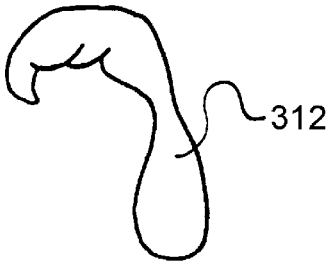

Attention is now called to FIGS. 3A and 3B which respectively show different embodiments of a hair simulation member 311, 312. The members 311, 312 are preferably configured for removable mounting on the display member 322 as depicted in FIG. 5. Alternatively, the hair member can be generated by the computer software. A separated hair member not only provides opportunity for an user to try the looking of different hair style but also enabling a standard size facial displaying area to work with people of different hair styles. Note also in FIG. 5 that an upper garment 333 is supported and conceals the elongate arms 210, 212 thus forming an outfit with the lower garment skirt 334. For a realistic facial presentation, the facial image is preferably to be printed onto a sheet of material and the excess portion around the sides of the facial image is trimmed off before placing the facial image onto the display member 322.

Figure 4:
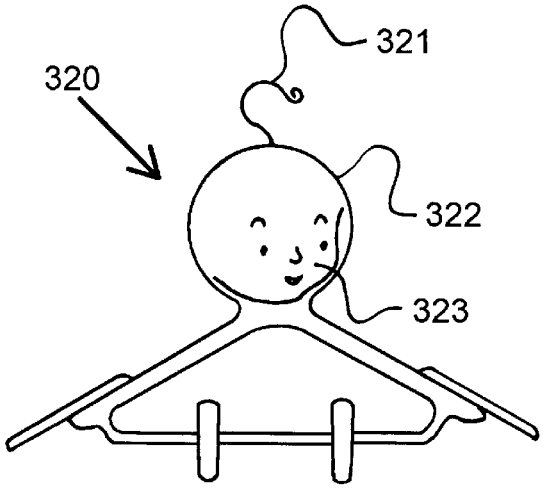
FIG. 4 depicts a life size human facial image printed onto the medial display portion of a garment hanger.

Accordingly, by providing the apparatus depicted in FIG. 4, modified by a visual representation of a user's face applied to the structural member display region 323, and optionally supplemented by a hair simulation member 311, a user is able to support articles of clothing on the apparatus 330, as depicted in FIG. 5, to enable the user to appraise the visual appearance of the outfit, i.e., collection of clothing articles and accessories, according to the matching effect with the actual facial image and the hair style selected.

Figure 7A:
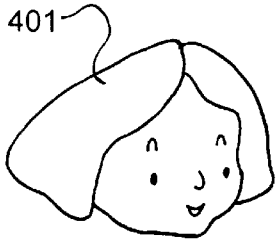
FIG. 7A is a front view of a personalized photo facial image.
Figure 8A:
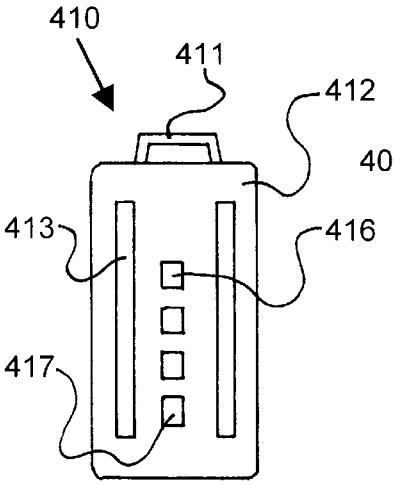
FIG. 8A is an alternative embodiment of the display region.
Figure 8B:
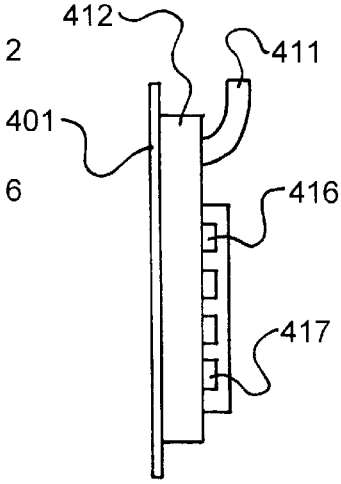
FIG. 8B is a side view of FIG. 8A.

FIG. 7A illustrates the photo image of a personalized facial representation. This facial image can be posted on a cardboard, properly trimmed along the boarder line and then attached onto a display region 323 (FIG. 4) or imprinted on the surface 323 directly. Alternatively, because the facial image of the person is rigidly supported by a cardboard, it can be attached with an alternative smaller supporter (FIG. 8A) located at the display region of the invention. The facial image can be glued to the surface 412 of the supporter 410. Alternatively it can be attached to the supporter by double sided tape or magnetic strip as depicted by strips 413 of FIG. 8A. FIG. 8B shows the side view of the display supporter. The shut off of the tool provides supporting holes 416 and 417 which are designed to receive the hook member of a traditional garment hanger. A vertical array of receivers are recommended so that the relative position of the facial image and that of the garment can be adjusted by selecting the most appropriate positioned receiver. Attention is now draw to the handle 411 of FIGS. 8A and 8B. This handle is very different in shape when compared with the suspension hook of a regular garment hanger. The purpose of the specially designed handle is for the customer to comfortably carry the display apparatus during shopping. A comfortable handle is preferred although a hanger hook will serve the purpose.

Figure 7B:
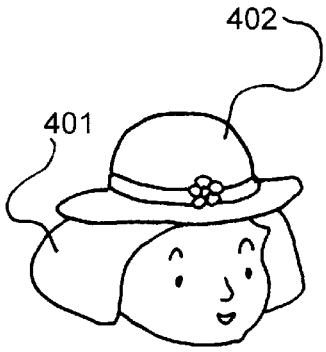
FIG. 7B is the personalized photo image of FIG. 7A coordinated with a hat.

FIG. 7B illustrates the facial image of FIG. 7A wearing a hat. When the top portion of the facial image is modified to provide appropriate supporting frame behind the facial image, a hat can be supported. With this modification, the personalized facial image of FIG. 7A can be used to appraise or select a hat, a cap or other kinds of head decorations. For that reason, the term garment, apparel or clothing as defined in this application should therefore include hats and head decorative items to be wear by the user.

Figure 9:
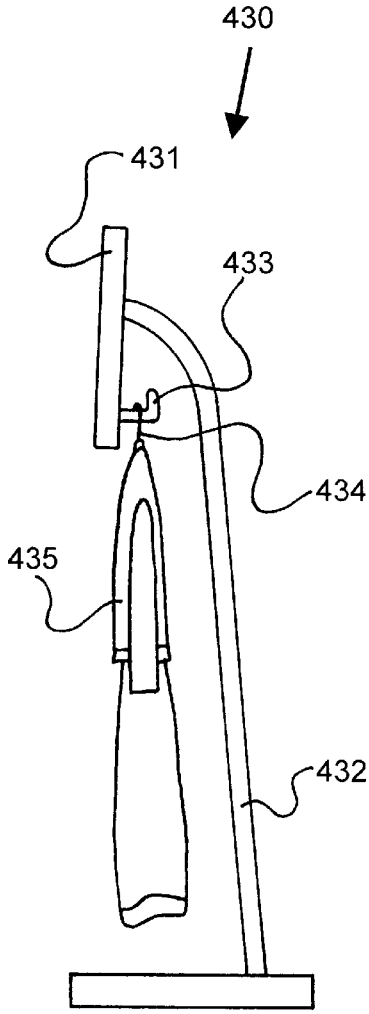
FIG. 9 is the side view of a floor stand supporting a display region and a matching garment hung on a hanger.

FIG. 9 illustrates an alternative preferred embodiment having the display member 431 supported by a floor stand 432. The receiver 433 located behind the display region receives the hook member 434 of a garment hanger supporting a garment 435. To provide a quick coordination and harmony effect to many different customers, the display region can be in the form of a mirror. This embodiment will naturally presents the particularly personalized facial image matched with a garment displayed when a customer stops by. In order to better fitting the different heights of people and provide a proper effect, the mirror display region needs to be articulated or vertically adjusted with any known adjustment design capable to provide the desirable adjustment effect.

Figure 10:
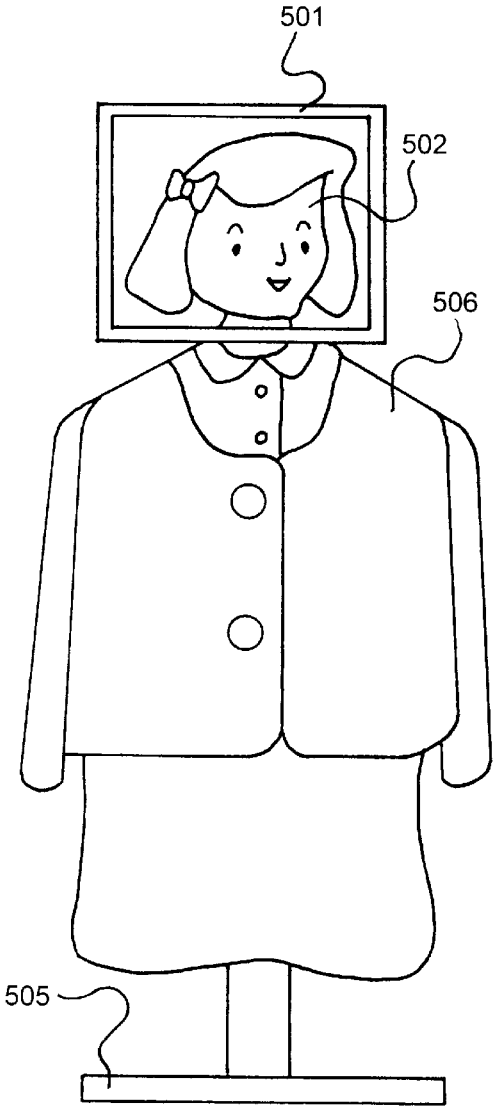
FIG. 10 is a front view of a floor stand having an electronics display device.
Figure 11:
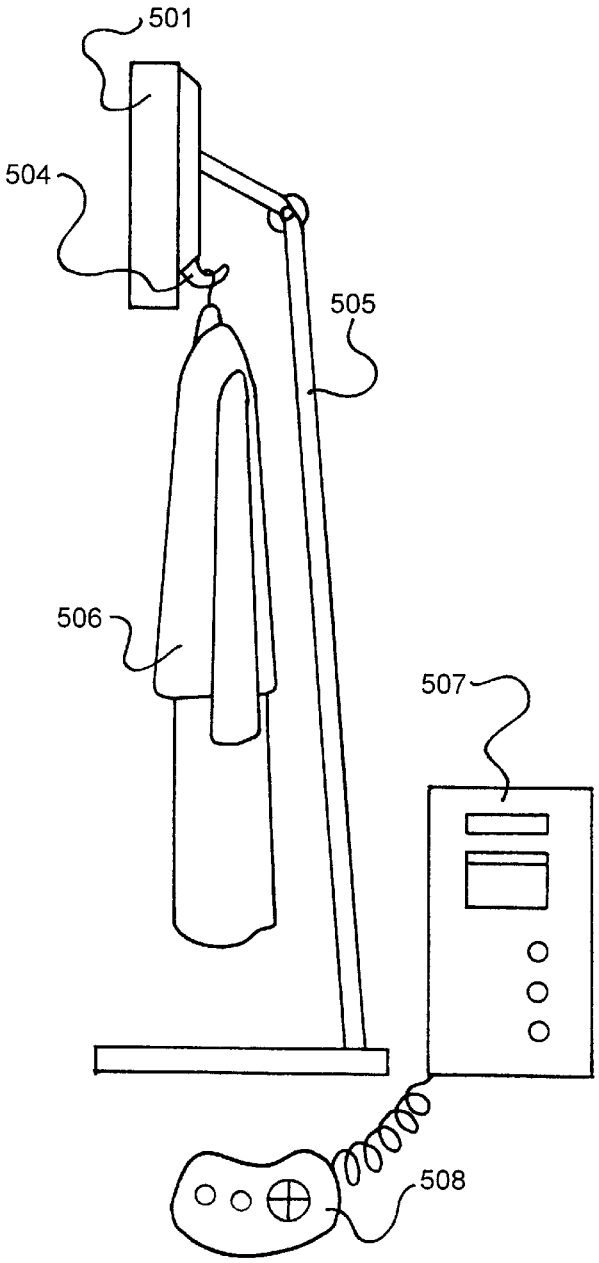
FIG. 11 is a side view of FIG. 10 together with a computer and controller.

FIG. 10 depicts another embodiment having the display region represented by an electronics display device such as a computer monitor. The electronics display device 501 is supported by the floor stand 505. The facial image 502 of an user is displayed on the screen. A garment 506 is positioned beneath the facial image displayed. LCD monitor is preferred due to the preferable thin profile of the display member and the light weight it carries. FIG. 11 is the side view of the set up shown in FIG. 10. A receiver 504 locates behind the display region receives the hook member of the hanger supporting the garment 506. The computing device 507 converts the digital facial imager of a person and display it onto the screen of the electronics display device 501. The computing device 507 may receive the image data from a remote computer storing a library of facial images. A controller or input device 508 enables users to key in their own code word and fetch their own personalized facial images to be displayed onto the display screen. The input device can also be used to modify the presentation of the facial image such as modifying the color balance and adjusting the relative position of the image.

Figure 12:
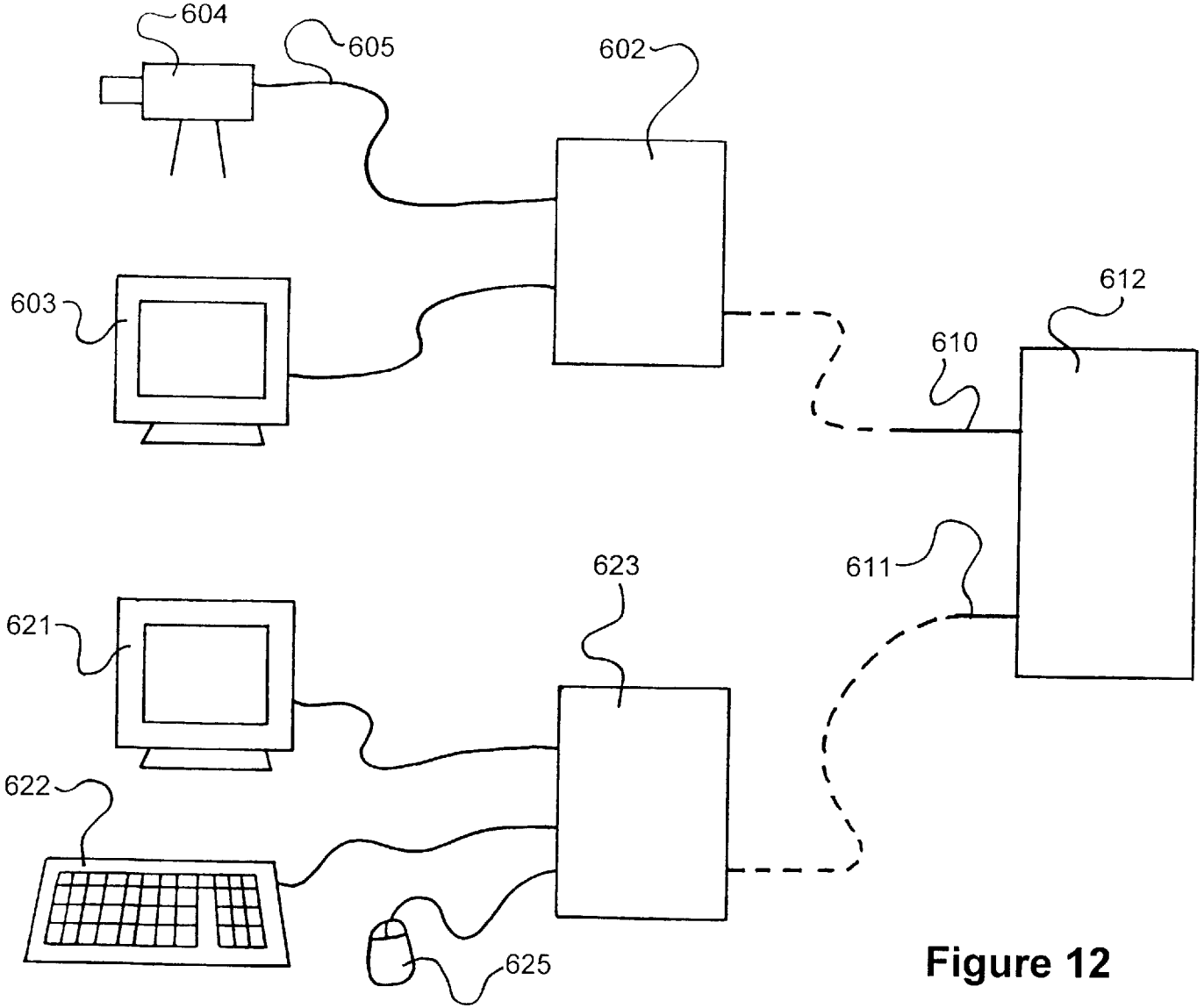
FIG. 12 shows a remote computer linked with a image capturing kiosk located at a point of sale and also a home computer connected through communication channels.

FIG. 12 shows a preferred system embodiment to use the information aspect of the invention. Video capturing device 604 in conjunction with computing device 602 captured the facial image of a person, converts the image into electronics data, usually represents by the digital numbers one and zero. The electronics image data stored in computer 602 is then transmitted to a remote computing device 612 through a communication channel 610. The image capture system and the data converting system is preferred to locate at a point of sale. A home computer in conjunction with a digital camera or a scanner may also be configured to perform the facial image capture function. A code comprising of one or more code words representing the person is assigned to identify the electronics image file captured. The similar set up of 604, 605 and 602 can be used to generate electronics image files of an assortment of garments and store the electronics garment image data at the local computer or the remote computer 612. A code comprising of one or more code words is assigned to identify one garment from another.

Computer 623 is also configured to connect with the remote computer 612 through a communication channel 611. Monitor 621 displays the matching picture of the selected facial image combined with the selected garment image. Codes representing the selected facial image and garment are entered into the computer 623 by input devices such as the keyboard 622 or the mouse 626. Usually the user may select a variety of garment images to match with the personalized facial image to determine which garment best fits with the personal characteristics of the user. Alternatively, users may coordinate and harmonize garment with the facial image of a friend or relative in order to select a garment gift for the particular friend and relative, without the real person to present on spot to support the selection and coordination process.

In one mode of operation, the camera and computer is set up at a point of sale and the customer takes a facial image at this spot. The customer may use the monitor 603 connected with the same computer 602, or the monitor 621, connected to the computer 623 to coordinate this facial image with different garment image stored in any of the computers 602, 612 and 623.

In another mode of operation, the monitor 621 represents the facial displaying monitor 501 of FIG. 11. In this case, the regional computer 507 is identical to the computer 623. When the customer feels interest about the garment 506, he/she just key in the code represents his/her facial image. The image will be shown on the monitor and the customer is ready to appraise how he/she will look with the garment 506 without actually putting the garment on.

In another mode of operation, the system 621, 622 and 623 represents a home computer. The customer may connect this home computer with a remote host computer through a communication channel such as internet to fetch any facial image and/or garment images stored over there. In order to save the response time, the facial image of the customer is preferable to be stored at the local home computer 623, because the personalized facial image of the customer will most likely be retrieved by this computer only.

It should be noted that the communication channels 610 and 611 can be any type of channels connecting two computers together, as defined in this specification, or any other way to connect between two computers not mentioned in the specification. It should be noted that the image capturing computer 602 and the image reading computer 623 may in fact be the same single computer to carry out the preferred function of the subject invention. In this situation the communication channels 610, 611 become the same single communication channel.

From the foregoing, it should now be appreciated that applicant has disclosed herein embodiments of an apparatus which function to display a personalized facial image of a real person and which functions to support articles of clothing. It is intended that apparatus in accordance with the invention be utilized by a user to easily coordinate, appraise or harmonize apparel before putting the clothing on. It is appreciated that the display region displaying the facial image may be represented by a computer monitor or a mirror. Particularly, it should be noted that the personalized image may be provided by simply transferring the facial image of a person to the display area, covering the display region with a mirror or providing an electronics means such as LCD monitors to represent the display region. It is contemplated that an apparatus in accordance with the invention be available from electronics images fetched from a remote computer via a communication channel. It is disclosed that the personalized facial image of a real person can be combined with an image of a selected garment to serve the same application purpose. Although detailed embodiments of the invention have been disclosed, it is recognized that variations and modifications, all within the spirit of the invention, will occur to those skilled in the art. It is accordingly intended that all such variations and modifications be encompassed by the appended claims.

What is claimed is:

1. The method for harmonizing apparel comprises the steps of:

(1) capturing the facial image of a person and converting said image into electronic data;

(2) providing supporting means to support a garment;

(3) providing a display member having an electronics display means located next to the appropriate location of said garment for displaying the captured image of step (1).

2. The method of claim 1 further comprising a step to provide a computer to store data representing the facial image of step (1).

3. The method of claim 1 wherein said steps are provided at a point of sale.

4. The method of claim 1 further comprising a step to collect at least a second view of said facial image to represent the looking of said person from a different angle other than the front view.

5. The method of claim 1 further comprising a step to provide adjustment means for adjusting the relative position of said garment from said display member.

6. The method of claim 1 further comprising a step to assign a code representing said person of step (1).

7. The method of claim 1 further comprising a step to provide control means for controlling the facial image representation displayed on said electronics display means.

8. The method of creating a display apparatus comprising the steps of:

(1) defining a display member having a display region;

(2) providing a supporting member located appropriately next to said display region for supporting a garment;

(3) transferring the personalized facial image of a real person into electronic data; and (4) provide said personalized facial image from said electronic data for displaying on said display region.

9. The method of claim 8 for creating a display apparatus further comprising a step to display said facial image onto a computer monitor.

10. The method of claim 8 for creating a display apparatus further comprising a step to retrieve any of said electronics image data from a remote computer.

11. The method of claim 10 for creating a display apparatus wherein said electronics image data is retrived from the internet or the world wide web.

12. The method of claim 8 for creating a display apparatus wherein a code is assigned to represent any of said electronics image data.

13. The method of claim 8 for creating a display apparatus further comprising a step to provide an adjustment mechanism configured to adjust the relative position of said garment from said display member.

14. The method of claim 8 for creating a display apparatus further comprising a step to capture said facial image process at a location around a point-of-sale.

15. The method for a person to coordinate or harmonize apparel comprises the steps of:

(1) capturing the personalized facial image of said person and converting said image into electronic data;

(2) providing a supporting member to support a garment;

(3) providing a display member located next to the appropriate location of said garment for displaying the captured facial image of step (1).

16. The method of claim 15 wherein said display member comprises an electronics display means.

17. The method of claim 15 further comprising a step to provide a computer to store data representing the facial image of step (1).

18. The method of claim 15 wherein said steps are provided at a point of sale.

19. The method of claim 15 further comprising a step to collect at least a second view of said facial image to represent the looking of said person from a different angle other than the front view.

20. The method of claim 15 further comprising a step to provide adjustment means for adjusting the relative position of said garment from said display member.

21. The method of claim 15 further comprising a step to assign a code representing said person of step (1).

22. The method of claim 16 further comprising a step to provide control means for controlling the facial image representation displayed on said electronics display means.

23. The method of claim 15 further comprising a step to store said electronic data.

* * * * *